United States Patent [19]

Devlin

[11] 4,353,063

[45] Oct. 5, 1982

[54] BUS DESTINATION SIGN WITH PROGRAMMED DESTINATION NAME AND MANUALLY SETTABLE ROUTE NUMBERS FOR COMBINED DISPLAY

[75] Inventor: Thomas A. Devlin, Waterford, Mich.

[73] Assignee: Vultron, Inc., Waterford, Mich.

[21] Appl. No.: 173,787

[22] Filed: Jul. 30, 1980

[51] Int. Cl.[3] ..... G09G 3/20

[52] U.S. Cl. ..... 340/798; 340/801; 340/87

[58] Field of Search ..... 340/806, 808, 792, 798, 340/801, 800, 22, 87

[56] References Cited

U.S. PATENT DOCUMENTS

| | | | |
|---|---|---|---|
| 3,594,778 | 7/1971 | Herald et al. | 340/806 |
| 3,742,485 | 6/1973 | Summers | 340/808 |
| 3,750,138 | 7/1973 | Burgan et al. | 340/798 |
| 4,109,245 | 8/1978 | Hedin | 340/808 |

*Primary Examiner*—Marshall M. Curtis

*Attorney, Agent, or Firm*—Reising, Ethington, Barnard, Perry & Brooks

[57] ABSTRACT

A destination sign for buses is provided with means for adding a route number to the display device independently of the destination name displayed on the sign. The destination sign is of the electronic type in which a long destination name is displayed by showing two or more word units in time sequence on the same display device (10). The word units are stored in memory (18); a destination name selector (14) and logic means (16) addresses the desired combination of word units in sequence. A route number selector (24) generates a route number signal independently of the destination name selector. The memory and the route number selector are selectively coupled by switching means (20) to a character generator (22) which controls the energization of the display device according to the characters to be displayed in the destination message. A route number flag signal is stored in memory with short destination names and the flag signal controls the switching means so that the route number is automatically displayed with the short word unit of the destination name.

8 Claims, 7 Drawing Figures

BUS DESTINATION SIGN WITH PROGRAMMED DESTINATION NAME AND MANUALLY SETTABLE ROUTE NUMBERS FOR COMBINED DISPLAY

FIELD OF THE INVENTION

This invention relates to destination signs for buses and trains; more particularly, it relates to electronic destination signs with means for displaying a combined destination name and route number.

BACKGROUND ART

Destination signs for buses and trains must be changeable according to the particular route of the vehicle and each sign must be capable of displaying a large number of different destination messages. The typical destination name requires many different alphanumeric characters and the sign must be changeable quickly from one name to another.

It is usual practice to display a route number (or "run number") with each destination name. The route number and the destination name can be combined and the entire message stored in memory and called up as needed for display.

An electronic display system which is admirably suited for a destination sign operating in the above described manner is disclosed in the U.S. Pat. No. 3,750,138 granted July 31, 1973 to Burgan et al. A bus system in a metropolitan area often uses the same destination name with many different route numbers. For example, the destination name "HOLLYWOOD AND VINE" may be used on many different buses, each of which proceeds to that destination by different routes with identifying route numbers such as 124, 235, 313 and so on. This results in many different messages all of which have the same destination name. Accordingly, each different message requires a separate memory location and a large memory capacity is required.

Destination names frequently are made up of more than one word and the full name includes a large number of alphanumeric characters. The number of characters will often exceed the number of character modules in the display device and hence the full name cannot be displayed at one time. According to the Burgan et al U.S. Pat. No. 3,750,138 cited above, a sequential display may be used. For this purpose the destination name is divided into plural words or "word units" with the successive word units of the name being displayed in time sequence on the same character modules of the display device. This is a highly advantageous in that it avoids the need for having an unduly long display device or, alternatively, having a display device with two or more rows of character modules.

It would be desirable to have a destination sign which can display the destination name and route number without requiring large memory capacity or a complex central processing unit for combining names and numbers. An object of this invention is to provide an electronic destination sign which overcomes certain disadvantages of the prior art in displaying destination messages which may comprise different route numbers with the same destination name. In general, it would be desirable to have an alphanumeric sign in which displays a large number of different messages each of which is made up of two or more parts with one part being generated by a manually actuable selector rather than being stored in memory.

SUMMARY OF THE INVENTION

In accordance with this invention, an alphanumeric sign is provided with means for displaying a message which is made up of a first part which is selectively called-up from a memory and a second part which is independently generated by a manually actuated selector. This is accomplished by a sign including an alphanumeric display device, a memory means for storing a multiplicity of primary word signals each constituting one part of a message and a secondary word signal selector for producing a multiplicity of secondary word signals each constituting another part of a message. Means including a first manually actuable selector means is coupled with the memory means for selectively accessing any one of the primary word signals. The secondary word signal selector includes a second manually actuable selector means for producing any one of the multiplicity of secondary word signals. A character generator, which is responsive to a word signal for producing a character generator signal, controls the energization of the display device. Means are operatively coupled with the memory means and with the secondary word signal selector for selective coupling thereof with the character generator for causing display device to display a message including the selected primary word and the selected secondary word.

Further, in accordance with this invention, an electronic destination sign is provided with means for producing a destination message with a route number which is selectable independently of the destination name. In particular, a desired destination name may be selected from memory by a manual input device. In addition, a route number may be selected by a manual input device and displayed in combination with the destination name. Any destination name may be combined with any route number and the route number signals are generated independently of the destination names.

This is accomplished in an electronic destination sign having a number of character modules arranged in a single row, a memory for storing word units which can be displayed in time sequence to form a message, a manually actuated message selector, logic means responsive to the selector signal for producing a memory address signal for accessing the word units in sequence, a character generator responsive to the word unit signal for producing a character generator signal to control the elements of the display device, and clock means for causing the character generator to selectively energize the display device to form one word unit at a time, the destination sign being characterized in that it comprises a manually actuated route number selector coupled with the character generator for producing a generator signal corresponding to the characters of the selected route number, and means operatively connected with the character generator and the route number selector for selectively combining the selected route number with the destination name.

A more complete understanding of this invention may be obtained from the detailed description that follows taken with the accompanying drawings.

BEST MODE FOR CARRYING OUT THE INVENTION

Figure 1:
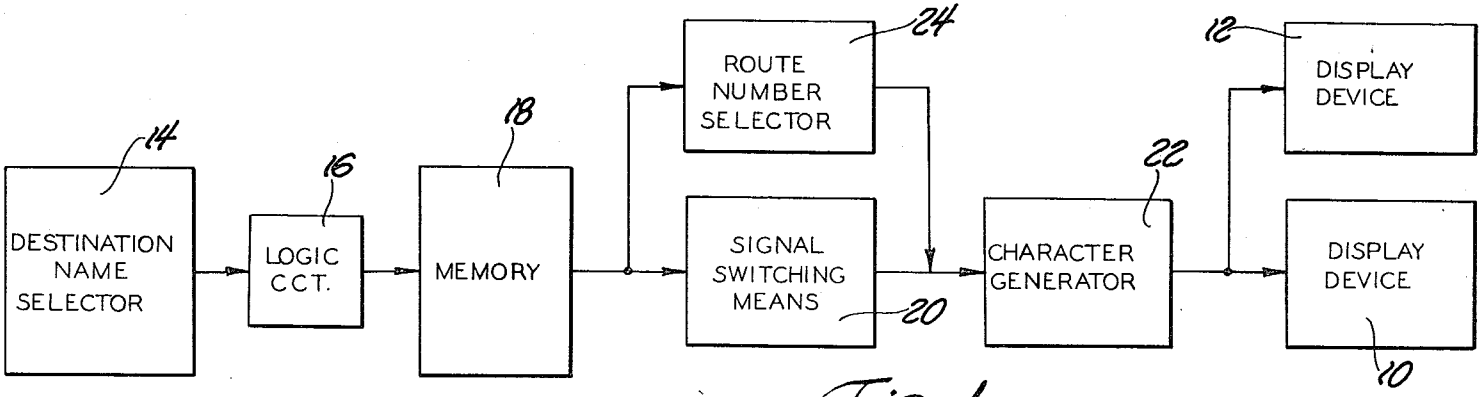
FIG. 1 is a block diagram of the destination sign of this invention.

Referring now to the drawings, there is shown an illustrative embodiment of the invention in an electronic destination sign which is adapted to display a destination message which is manually selectable by the bus driver. In particular, the destination message comprises a destination name and a route number, with the route number being selectable independently of the name. The route number is combined with the destination name in such a manner that it does not interfere with the display of the name. It will be appreciated, as the description proceeds, that the invention is useful in a variety of applications. In general, the destination name can be regarded as being made up of one or more primary words which are used as one part of a message. The primary words are represented in memory by primary word signals. The route number can be regarded as a secondary word forming another part of a message. A desired message is formed by selectively combining one or more primary words with a secondary word.

FIG. 1 is a block diagram of the destination sign of this invention. In general, the sign comprises a destination message display device 10 which is typically mounted on the front of a bus and which is adapted to display a destination name and route number. A route number display device 12, typically mounted on the side of the bus, is adapted to display the route number pertaining to the destination of the bus. The sign is adapted to permit the bus driver to select the destination name and to independently select the route number according to the job assigned to the particular bus. For this purpose, the sign includes a destination name selector 14 which is coupled through a logic circuit 16 with a memory 18. The logic circuit supplies an address signal to the memory corresponding with the selected destination name. The output of the memory is supplied through a signal switching means 20 to a character generator 22 which is coupled with the destination message display device 10 and the route number display device 12. The sign additionally comprises a manually controlled route number selector 24 which is manually actuated by the bus driver and which is enabled by an output from the memory 18 at a programmed point in the generation of the destination message. The route number selector 24 produces a route number signal which is applied to the character generator 22. The signal switching means 20 is operated under the control of the word unit signal at the memory output to selectively apply the route number signal and the word unit signal to the character generator. This causes the destination message display device 10 to display the destination message comprising the destination name and the route number in a programmed sequence. It also causes the route number display 12 to continuously display the route number.

Figure 2:
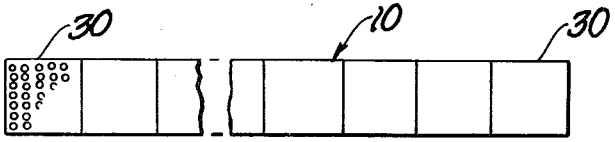
FIG. 2 illustrates the display device of the sign.

Before proceeding with a more detailed description of the electronic destination sign, it will be helpful to consider the use of the display device 10 with different examples of destination messages, i.e. destination names and route numbers. As shown in FIG. 2, the display device for the destination message comprises a single row of character modules 30 each of which is adapted to display one alphanumeric character at a time. In the illustrative embodiment, the display device comprises a plurality of character modules 30 which are disposed in a linear array to form a single row. Each character module 30 is of the type which is used in a "dot sign", i.e. each module comprises a matrix of "dots" with each dot comprising a pivoted disc with an electromagnet for flipping the disc so that either its light side or dark side is displayed. Such modules are commercially available from Ferranti-Packard, Ltd., of Ontario, Canada. As shown in FIG. 2, each character module comprises a $5\times7$ array of dots. The matrix of discs is capable of forming any alphanumeric character by selective flipping of the discs to show the dark side or the light side. It will be understood that the character modules 30 could also comprise electronic display units of the type using liquid crystals or other functionally equivalent devices.

Figure 3:
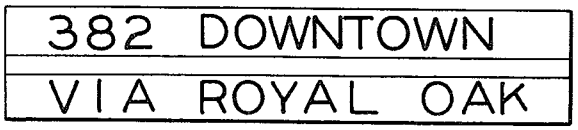
FIGS. 3, 4 and 5 show different examples of destination messages each comprising a destination name and route number.
Figure 4:
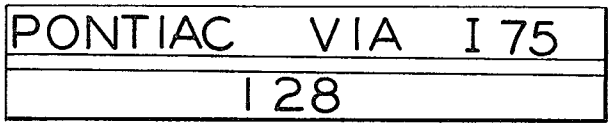
Figure 5:
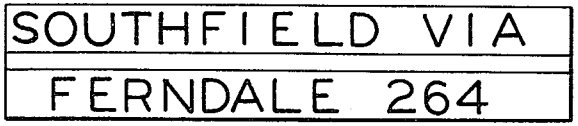

The display device 10 of the illustrative embodiment, as shown in FIG. 2, comprises a total of fifteen character modules 30. It will be understood that the number of modules for a given bus installation could be greater or less; however, the number and size of the modules is restricted by the available installation space on the bus and the specifications regarding readability of the sign from a distance. Since many destination messages comprise destination names and route numbers which exceed fifteen characters, it is necessary to divide the message into word units and display the word units in time sequence. As used herein, the term "word unit" means any combination of alphanumeric characters which can all be displayed at one time on the display device. The word unit is encoded in binary bits and stored in memory as a word unit signal which may also include certain control bits. In the illustrative embodiment, a word unit is fifteen characters. For example, as shown in FIG. 3 the destination message "382 DOWNTOWN VIA ROYAL OAK" is divided into two word units, one on each line of FIG. 3. In example of FIG. 3 the route number "382" is part of the first word unit and appears on the first line. As shown in FIG. 4, the destination message "PONTIAC VIA I-75 128" is divided into two word units with the second word unit comprising only the route number which appears by itself on the second line. As shown in FIG. 5, the destination message "SOUTHFIELD VIA FERNDALE 269" includes the route number at the end of the second word unit on the second line. It will be understood that longer messages which may require three or more word units may be displayed by showing the word units in time sequence; however, for ease of readability and simplicity it is desirable to have only two word units per message. As indicated by the example messages shown in FIGS. 3, 4 and 5, the route number may need to be inserted before or after a destination name in order to avoid the need for showing a part of a word on one line and part on another or in order to avoid adding a third line to the message for the route number.

Figure 6:
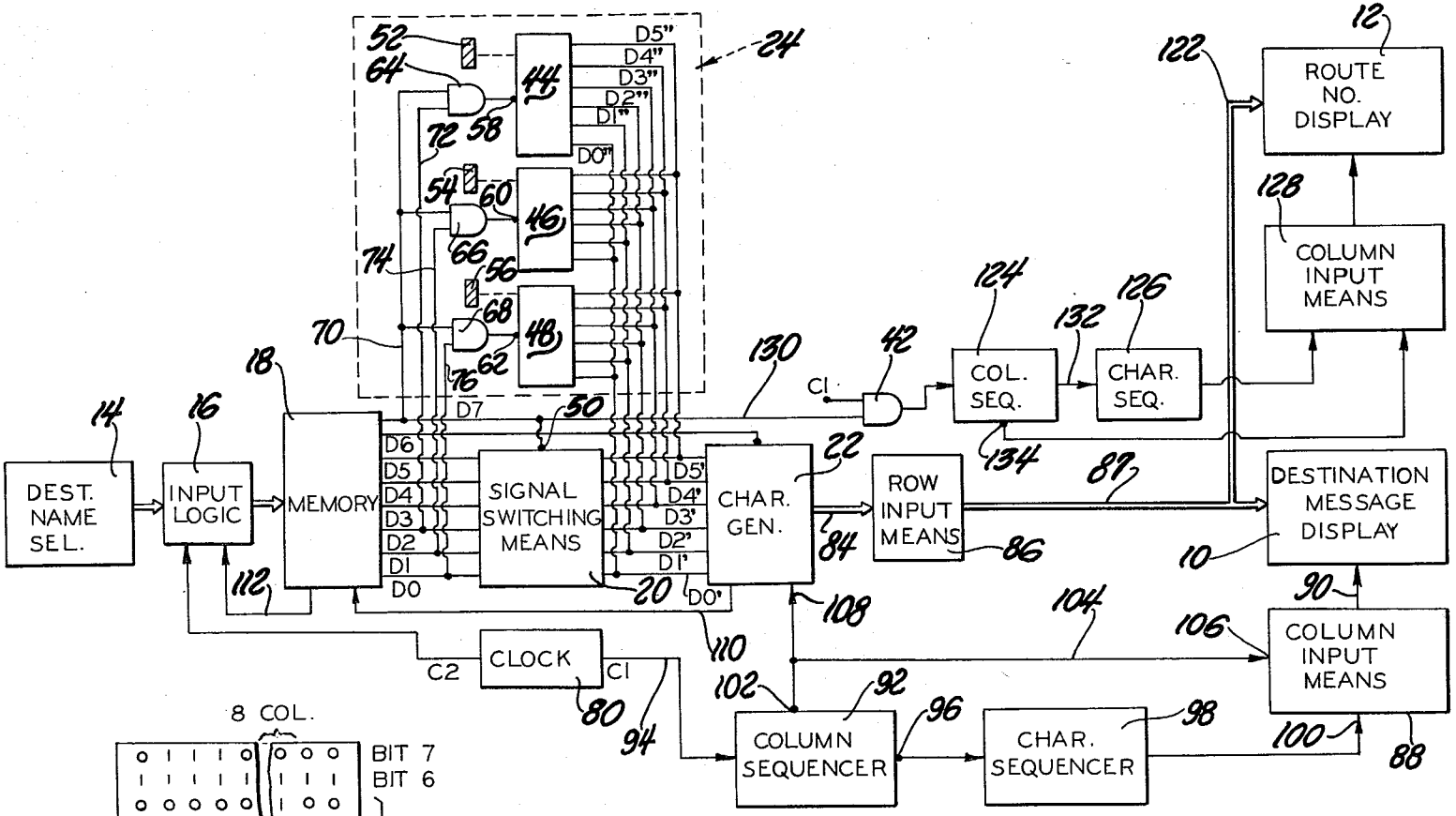
FIG. 6 is a diagram which shows details of the destination sign.

Referring now to FIG. 6, the destination sign will be described in further detail. The destination name selector 14 comprises a set of three encoding switches of the decimal to binary type, preferably conventional thumb wheel switches. The selector 14 is used by the bus driver in conjunction with a look-up table which shows a three digit decimal number corresponding to each destination name. When the three digit number is set into the destination name selector 14 it produces a destination name signal which represents the selected name and which is applied to the input logic circuit 16.

The input logic circuit 16 is operative to produce a memory address signal and a word unit sequence signal in response to the destination name signal from the selector 14. For example, assume that the look-up table shows that the destination name "DOWNTOWN VIA ROYAL OAK" is identified by the three digit number "145". To select this destination name, the bus driver sets the destination name selector 14 to the number "145". This destination name comprises two word units, namely "DOWNTOWN" and "VIA ROYAL OAK" which are stored in memory 18 with each word unit at a different memory location. Accordingly, the input logic circuit 16 produces a memory address signal for the first word unit "DOWNTOWN", a second memory address signal for the word unit "VIA ROYAL OAK" and a sequence signal indicating the order in which the word units are to be generated. The memory address signals and the sequence signal are applied to the input of the memory 18.

Figure 7:
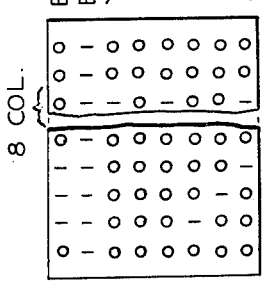
FIG. 7 shows an example of data storage in memory for use in explaining the operation of this invention.

The memory 18 is a programmable read only memory (PROM) which stores the word units and certain control signals for the character generator and the input logic circuit. Each word unit which is to be used in forming a destination name is allocated to a discrete memory location in the PROM. Each memory location is accessed in response to a memory address signal from the input logic circuit 16. The storage of data corresponding to each word unit in memory 18 is depicted in FIG. 7. The memory 18 has a parallel output comprising eight data lines D0 through D7 (see FIG. 6). Thus the memory has a capacity for producing an eight-bit data word. As depicted in FIG. 7, each memory location comprises a field of eight-bit data words with bits zero through bit seven corresponding with data conductors or bit-lines D0 through D7. The word units which are stored in memory 18 are made up of alphanumeric characters which are encoded in standard ASCII code. In this code, six bits are sufficient to define all of the required alphanumeric characters and one bit is required to specify whether a character is to be written in upper case or lower case. This leaves one of the eight bits available for any desired purpose. Bit seven is used as a flag or control signal to selectively call the route number signal at a predetermined point in combination with the word unit being read out of memory.

As shown in FIG. 7, the memory location stores fifteen eight-bit data words. Thus, each memory location has a sufficient capacity to store an alphanumeric character for each of the character modules in the display device 10. Each data word is represented, in FIG. 7, by a column of eight bits, shown as ones and zeros. For each data word, the bits are identified as bit zero through bit seven with bit zero being the bit at the bottom of the column and bit seven being the bit at the top of the column. The field of data words at the memory location includes fifteen columns of bits comprising ones and zeros. As indicated in FIG. 7, bits zero through five represent the alphanumeric characters, bit six specifies upper or lower case and bit seven is the flag signal for the route number display. The data words in the memory location are read out to the data bus in time sequence from right to left, as viewed in FIG. 7. It will be assumed that the example memory location of FIG. 7, stores a word containing eight characters, such as "FERNDALE". The first two columns of data words represent spaces, i.e. the first and second character modules will be blank. The next eight columns of data words represent the word for display in the third through tenth character modules of the display device. The eleventh column represents a space, i.e. the eleventh character module would be blank. The next four columns are not needed for the word and hence, if unused they would also represent spaces leaving the last four character modules blank. However, in the example of FIG. 7, the twelfth, thirteenth and fourteenth character modules are to be used for displaying the route number. For this purpose, bit seven in each of these three columns is a one-bit. Further, for this purpose, bit zero is a one-bit in the twelfth column of data, bit one is a one-bit in the thirteenth column and bit two is a one-bit in the fourteenth column. These one bits are used for sequencing the display of the digits in the route number as will appear subsequently. The remainder of the bits in each of the route number columns may be either a one-bit or a zero-bit since these remaining bit positions are not used, i.e. they are not applied to the character generator, as will appear subsequently.

As described above, the contents of each memory location which is accessed by the input logic circuit is read out in its entirety on data conductors or bit-lines D0 through D7. As shown in FIG. 6, bit-lines D0 through D5 are connected to the input of the signal switching means 20 and bit-lines D0, D1 and D2 are also connected to the input of the route number selector 24. Bit-line D6 is connected directly to the character generator 22 to select upper or lower case. Bit-line D7 is connected to the input of the route number selector 24 and also to an AND gate 42 for purposes to be described subsequently. The bit-line D7 is also connected with the control input 50 of the signal switching means 20.

The signal switching means 20 comprises a multiple pole, solid state switch. The bit-lines D0 through D5 from the memory 18 are connected with respective inputs of the signal switching means 20 and the respective outputs thereof are connected through bit-lines D0′ through D5′ to the inputs of the character generator 22. When a zero-bit is applied to the control input of the switching means 20 the switch is closed, i.e. each input is connected with respective output, and hence the word unit signal is applied from the memory 18 through the switching means 20 to the input of the character generator 22. When a one-bit is applied to the control input of the switching means, the switch is open and the data lines D0 through D5 are disconnected from the character generator 22.

The route number selector 24 comprises a set of decimal to binary selector switches 44, 46 and 48. The switches 44, 46 and 48 comprise manually actuated thumb wheels 52, 54 and 56, respectively, which may be set to select any digit, zero through nine. Each selector switch 44, 46 and 48 has a parallel output for generating a binary signal representing the decimal number which is set by the thumb wheel on the selector switch. The outputs of the selector switches 44, 46 and 48 are connected to bit-lines D0″ through D5″ which are connected, respectively, with bit-lines D0′ through D5′. The selector switches 44, 46 and 48 have clock inputs 58, 60 and 62, respectively. When the clock input is at logic low or zero, the output on each of the bit lines is at logic zero; when the input is at logic high or one, the output bit lines are driven to a logic state corresponding to the digital number which is set on the thumb wheel.

In order to read out the contents of the route number selector switches 44, 46 and 48 in timed sequence, the route number selector 24 is provided with AND gates 64, 66 and 68. Each of the AND gates has one input connected through a conductor 70 to bit-line D7 at the output of memory 18 so that the AND gates are all enabled when bit seven is a one-bit. A clock signal is supplied through the AND gates 64, 66 and 68 from the bit-lines D2, D1 and D0, respectively, on conductors 72, 74 and 76, respectively. Thus, when bit seven is a one-bit it is effective through conductors 70, 72 and 74 to enable the gates 64, 66 and 68 and it is effective at the control input 50 of the signal switching means 20 to open the switch. Thus, when bit seven is one-bit signifying that the route number is to be displayed, a one-bit on line D0 from memory 18 will clock the selector switch 48 through gate 68 and the least significant digit of the route number which is set on switch 48 will be applied to the input of the character generator 22. Similarly, a one-bit on line D1 from memory 18 will clock the selector switch 46 and the output thereof will be applied to the character generator 22. In a similar manner, a one-bit on the line D2 of memory 18 will clock the selector switch 44 through AND gate 64 and the output of the selector switch 44 will be applied to the input of the character generator 22.

As described above, the signal switching means 20 and the bit-line D7 comprise control means for selective coupling of the memory 18 and the route number selector 24 with the character generator 22.

The character generator 22 has a parallel input and responds to an input signal defining an alphanumeric character to produce sequential, parallel output signals for controlling the selective energization of the rows and columns of display elements in a character module. In the illustrative example, the character generator 22 receives the six-bit ASCII code at its input from either the memory 18 or the route number selector 24, according to the state of signal switching means 20. The character generator 22 has a seven-bit parallel output with each parallel bit-line corresponding to a row of display elements in the display module of the dot type display 10. Each character input signal to the character generator results in a sequence of output signals each of which corresponds to the successive columns of display elements in the character module. In the illustrative embodiment, each character module comprises an array of seven rows of dots and five columns of dots.

A system clock 80 is provided to generate timing and sequencing signals for the system. The clock 80 generates a first train of clock pulses C1 and a second train of clock pulses C2 which are of the same frequency but 180° out of phase with each other. The clock pulses C2 are applied to the input logic circuit 16 so that the switching operations therein are performed between the clock periods of the memory and the character generator.

In order to control the energization of the individual dots in each row of the character modules, the output of the character generator 22 is applied through a bus 84 to a row input means 86 of the display 10. The row input means 86 determines for each row, in response to the logic level on the individual lines of bus 86, whether the set or reset input of the dot is to be energized. The output of the row input means is connected through a bus 87 to the row input of the display device 10. In order to control the energization of the dots one column at a time, a column input means 88 is connected with the display 10 through the conductor 90. The character generator 22 and the column input means 88 are controlled by a column sequencer 92 which has its input connected through a conductor 94 with the output C1 of clock 80. A first output 96 of the column sequencer 92 is applied to the input of a character sequencer 98 which has its output connected with a first input 100 of the column input means 88. A second output 102 of the column sequencer 92 is applied through a conductor 104 to a second input 106 of the column input means 88. The second output 102 of the column sequencer 92 is also applied to a sequencing input 108 of the character generator 22.

When a character signal is applied to the input of the character generator 22, a clock pulse C1 causes the column sequencer 92 to produce a signal at the output 102 which is applied to the character generator 22. As a result, the character generator applies the row data for the first column of dots in the first display module. The same signal from the output 102 of the column sequencer is applied through line 104 to the column input means 88 which enables the first column of dots of the first display module. When the next clock pulse C1 of clock 80 is applied to the column sequencer 92 it causes the character generator to output the row data for the second column of dots of the first display module and at the same time the column input means 88 enables the second column of dots in the first display module. This continues until the fifth clock pulse C1 from clock 80 is applied to the column sequencer 92 which causes the character generator to output the row data for the fifth column of dots in the first display module and which causes the column input means 88 to enable the fifth column of dots in the first module. At the end of the fifth clock pulse, the character generator 22 applies a signal over a conductor 110 to the memory 18 to cause the memory to output the next character signal on data lines D0 through D7, to define the second character of the selected word unit. This output of the memory 18 is controlled by the input logic circuit 16 which in turn is operated under the timing of the clock pulses C2 from clock 80. Accordingly, the output of the next character signal from the memory 18 occurs between the clock pulses of the output C1. As a result, the character generator 22 is prepared to generate the data for the character in the second display module. When the next clock pulse C1 (the sixth clock pulse) is applied to column sequencer 92, the character generator outputs the row data for the first column of the second display module. Also, after the last clock pulse from output C1 for the first character, the column sequencer 92 applies a signal to the input of the character sequencer 98. The character sequencer 98 applies a signal to the input 100 of the column input means 88 causing it to apply the succeeding pulses on its input 106 from the column sequencer 92 to the successive columns of the second display module. This operation is continued until the last character of the selected word unit from memory 18 is generated for the corresponding module in the display device 10. At that time a feedback signal from the memory 18 is applied through a conductor 112 to the input logic circuit 16. This causes the next word unit, if any, to be addressed in memory and the same operation continues so long as the word unit is made up of alphanumeric characters. If however, the word unit contains a route number flag signal, the control of the display device 10 is shifted to the route number selector 24, as will be described below. After the last character of the destination message has been displayed, the display sequence is repeated so that the entire message is displayed repeatedly line-by-line.

In accordance with this invention, the destination message display device 10 is operative to display the route number at a selected point in the destination message. As discussed above, the route number may be inserted before, after or between word units of the message which are stored in the memory 18. As described above, the full destination message requires sequential display of the parts of the message, i.e. a two line message is displayed by alternately flashing the two lines on the display device 10. A separate route number display device 12 is provided so that the route number can be shown continuously in conjunction with the sequential or flashing destination message. Route number display devices are typically installed in side windows of a bus. The route number display device 12 comprises a set of three character modules for the three digits of a typical route number. The route number display device 120 is controlled in a manner similar to that of the display device 10. The output of the row input means 86 is applied through bus 122 to the route number display device 120. A separate column sequencer 124, character sequencer 126 and column input means 128 are provided for the route number display device 120. The clock pulses C1 from the clock 80 are applied to one input of the AND gate 42 which has its output connected with the input of the column sequencer 124. The other input of the AND gate 42 is connected through a conductor 130 with the bit line D7 at the output of memory 18. Thus, when bit seven is at logic high, the AND gate 42 is open and the clock pulses C1 are applied to the column sequencer 124. A first output 132 of the column sequencer is applied to the input of the character sequencer 126. The output of the character sequencer is applied to a first input of column input means 128 which has its output connected with the column input of the route number display device 120. The second output 134 of the column sequencer 124 is applied to a second input of the column input means 128 so that the output thereof advances to the next character module after the last column of each character. The clock pulses C1 are applied through the column sequencer 92 at output 102 to the control input 108 of the character generator as described above. Thus, the control of the route number display device 12 is the same as that described for the destination message display device 10 except that the route number display device is energized only when bit seven on bit-line D7 is at logic high. Accordingly, no character other than the route number characters are applied to the display device 12. It is actuated repeatedly with the same route number digits and thus it displays the route number continuously.

The overall operation of the destination sign will now be described with particular reference to FIG. 6. As discussed above, the destination message to be displayed on the display device 10 is selected manually by the bus driver in accordance with the destination and route assigned to the bus. As a result of the manual selection, the control system for the destination sign operates automatically to produce the selected destination message on the display device 10.

Assume, for example, that the destination message to be displayed is "SOUTHFIELD VIA FERNDALE 269", as shown in the example of FIG. 5. The destination name "SOUTHFIELD VIA FERNDALE" is identified in the look-up table by a three digit number "215". To select this destination name, the bus driver sets the destination name selector 14 to the number "215". The route number to be displayed in the destination message is "269". To select this route number for display, the bus driver sets the route number selector 24 to the number "269". The destination name, as shown in FIG. 5, comprises two word units, namely "SOUTHFIELD VIA" and "FERNDALE" which are stored in memory 18 with each word unit at a different memory location. The first word unit "SOUTHFIELD VIA" requires fourteen characters and hence leaves only one unused character module in the display device 10. However, the second word unit "FERNDALE" requires only eight characters and therefore leaves enough character modules for adding the route number "269".

The word units which are stored in memory are individual words and combinations of words which make up the destination name required for a given bus operating system. The word units are selectively read out of memory in order to display the desired destination name. A short word, i.e. one which has fewer characters than the number of character modules in the display device 10 can be stored in memory in combination with a route number flag signal so that the route number is displayed on the same line with the short word unit. In the example, the word unit "FERNDALE" is a short word and it leaves an ample number of character modules for the display of the three digit route number. Accordingly, when the word "FERNDALE" is stored in memory at a location such as that described with reference to FIG. 7, the memory location has bits in certain columns of data words allocated to the route number flags. For example, in the first two columns of data words, the character bits (bits zero through five) will be encoded to represent spaces. The next eight columns of character bits will be encoded to represent the characters of the word "FERNDALE". The remaining of five columns of character bits will be encoded to activate the read-out of the selector switches 44, 46 and 48. In this same memory location, the upper case-lower case bit (bit six) will be encoded to represent upper case letters for the characters, i.e. bit six will be a one-bit in each column. The flag bits (bit seven) will be encoded to call for a route number display. For this purpose, bit seven will be a zero-bit in columns one through eleven and it will be a zero-bit in column fifteen; however, bit seven will be a one-bit in columns twelve, thirteen and fourteen. These one bits are the route number flag signal which enable the route number selector 24 to cause the character generator 22 to produce the route number on the display devices 10 and 12.

With the destination name selector 14 and the route number selector 24 set as described above, the character generator 22 will be operated to produce a display of the entire destination message on the display device 10 and a display of the rout number on the display device 120. In this operation, the first word unit "SOUTHFIELD VIA" is addressed in memory by the input logic circuit 16. The successive characters of that word unit are outputted sequentially under the control of clock pulses C1 through the signal switching means 20 to the character generator 22. (For this word unit, bit seven is a zero-bit in all columns and hence there is no route number flag signal. As a result, the route number selector 24 is not enabled and the output thereof is inactive.) Accordingly, the character generator 22 outputs the row data to the display device 10 through row input means 86 at the clock rate of pulses C1. The row data is applied to the successive dot columns of the successive character modules under the control of the column input means as previously described. Thus, the first word unit "SOUTHFIELD VIA" is displayed on the display device 10.

The next word unit "FERNDALE" is addressed by the input logic circuit 16 immediately upon completion of the display of the first word unit. The second word unit is outputted from memory 18 character-by-character and the character signals are applied through the signal switching means 20 to the input of the character generator 22. This continues until the word "FERNDALE" and the first space following the word are displayed on character modules three through eleven of the display device 10. This is done during the read-out of the first eleven columns of data words in the memory location. In these columns, there is no route number flag, i.e. bit seven is a zero-bit. However, in bit columns twelve, thirteen and fourteen, bit seven is a one-bit. Also, bit zero in the bit column twelve is a one-bit, bit one in bit column thirteen is a one-bit and bit two in column fourteen is a one-bit. The remaining character bits in columns twelve, thirteen and fourteen are zero bits and bit six is a one-bit signifying upper case.

Accordingly, when bit column twelve is read out, bit seven, a one-bit is applied to AND gates 64, 66 and 68, and is effective to enable the route number selector 24. Bit seven is also applied to input 50 of signal switching means 20 and turns it off. Bit zero in bit column twelve is a one-bit and is applied through AND gate 68 to the clock input of the selector switch 48. Accordingly, the route number signal which is stored in selector switch 48 is applied to the input of the character generator 22 and the first digit "2" of the route number is displayed by display device 10. At the same time, the first digit "2" of the route number is displayed by the route number display device 12. On the next clock pulse C1, the succeeding bit column thirteen is read-out of memory; bit seven enables the route number selector 24 and is supplied to input 50 of the signal switching means and turns it off. Bit one is a one-bit in column thirteen and is applied through the AND gate 66 to the selector switch 46 the output thereof is applied to character generator. This causes display device 10 and display device 12 to display the second digit "6" of the route number. In the same manner, bit column 14 is read out of memory 18 by the next clock pulse C1. Bit seven enables the selector switch 24 and the AND gate 42 and turns off the signal switching means 20. Bit two in column 14 is a one-bit and is applied through the AND gate 64 to the selector switch 44 and the output thereof is applied to the character generator 22. This causes the third digit "9" of the route number to be displayed on the display devices 10 and 12. The fifteenth bit column is next read out of memory. Bit seven is a zero-bit and disables the selector switch 24 and the AND gate 42 and also turns on the signal switching means 20. Accordingly, the character signal encoded in bit column fifteen is applied through the signal switching means 20 to the character generator 22 and the last character module of the display device 10 displays a blank or space. This process is repeated so that the first word unit "SOUTHFIELD VIA" and the combined second word unit and route number "FERNDALE 269" are alternately displayed on the destination message display device 10. At the same time the route number "269" is continuously displayed on the route number display device 12.

Although the description of this invention has been given with reference to a particular embodiment, it is not to be construed in the limiting sense. Many variations and modifications will now occur to those skilled in the art. For a definition of the invention reference is made to the appended claims.

What is claimed is:

1. In a sign of the type comprising an alphanumeric display device, a memory for storing a multiplicity of primary word signals each constituting one part of a message, means including a first manually actuable selector means coupled with said memory for selectively accessing any one said primary word signals, a character generator operatively coupled with said display device and responsive to a word signal for producing a character generator signal to control the energization of said display device to display a word corresponding to the word signal, said sign being characterized in that it comprises a secondary word selector including a second manually actuable selector means for producing a selected one of a multiplicity of secondary word signals each constituting another part of a message, said secondary word selector being coupled with said character generator for causing the display device to display a message including a selected secondary word, and control means including switching means operatively coupled between the memory and the the character generator for causing the display device to display, said control means including additional means responsive to said memory for actuating the switching means and for enabling the second manually actuable selector means to cause the display device to display the selected secondary word with the selected primary word.

2. The invention as defined in claim 1 wherein said additional means includes gate means coupled with said second manually actuable selector means, said memory being adapted to store a flag signal with certain of said primary word signals, coupling means for applying the flag signal to said gate means and to said switching means whereby the memory is effectively uncoupled from the character generator and the selected secondary word signal is applied to said character generator.

3. The invention as defined in claim 2 wherein said memory has a parallel output adapted to be coupled through said switching means to a parallel input of said character generator, said secondary word selector having a parallel output connected with the parallel input of said character generator, said parallel output of the memory including a bit line for coupling said flag signal to said gate means and to said signal switching means.

4. The invention as defined in claim 3 including an additional alphanumeric display device, said character generator being operatively coupled with said additional display device and responsive to a word signal for producing a character generator signal to control the energization of said additional display device, and additional gate means operatively coupled with said additional display device and with said bit line in the parallel output of said memory, said additional gate means being responsive to said flag signal for enabling said additional display device when said flag signal is in one logic state and for disabling said additional display device when said flag signal is in another logic state.

5. In a destination sign of the type comprising an alphanumeric display device having a number of character modules arranged in a row, each of the modules including an array of elements arranged in columns and rows, said elements being selectively energizable to display an alphanumeric character, a memory for storing a plurality of word unit signals each of which represents a number of characters equal to or less than the number of character modules, certain of the word units forming a massage when displayed sequentially, a destination name selector adapted to be manually actuated to produce a destination name signal representing a desired destination name, logic means coupled between said destination name selector and the input of said memory and responsive to the destination name signal for producing a memory address signal which defines the memory location and the sequence of the word units in said destination name, a character generator responsive to the word unit signals and coupled between said memory and said display device for producing a character generator signal to control the energization of the elements of the display device according to the characters making up the selected destination name, clock means operatively coupled with said character generator and with said display device for applying the character generator signal to the display device to selectively energize the rows of elements one column at a time to form the characters of one word unit at a time on said display device, said destination sign being characterized in that it comprises a route number selector adapted to be manually actuated to produce a route number signal which is to be displayed with said destination name, said route number selector being coupled with the character generator for producing a character generator signal corresponding to the characters of the selected route number, and control means including switching means operatively coupled between said memory and the character generator for causing the display device to display the selected destination name, said control means including additional means responsive to said memory for actuating the switching means and for enabling the route number selector to cause the display device to display the selected route number with the selected destination name.

6. The invention as defined in claim 5 wherein said additional means includes gate means coupled with said route number selector, said memory being adapted to store a flag signal with certain of said destination name signals, coupling means for applying the flag signal to said gate means and to said swiching means whereby the memory is effectively uncoupled from the character generator and said selected route number signal is applied to said character generator.

7. The invention as defined in claim 6 wherein said memory has a parallel output adapted to be coupled through said switching means to a parallel input of said character generator, said route number selector having a parallel output connected with the parallel input of said character generator, and said parallel output of the memory including a bit line for coupling said flag signal to said gate means and to said switching means.

8. The invention as defined in claim 7 including an additional alphanumeric display device, said character generator being operatively coupled with said additional display device and responsive to route number signal for producing a character generator signal to control the energization of said additional display device, and additional gate means operatively coupled with said additional display device and with said bit line in the parallel output of said memory, said additional gate means being responsive to said flag signal for enabling said additional display device when said flag signal is in one logic state and for disabling said additional display device when said flag signal is in another logic state.

* * * * *